United States Patent [19]

ReVelle

[11] 4,385,466

[45] May 31, 1983

[54] ROLLABLE TOY

[76] Inventor: Charles S. ReVelle, 826 Loyola Dr., Towson, Md. 21204

[21] Appl. No.: 326,518

[22] Filed: Dec. 2, 1981

[51] Int. Cl.[3] ..... A63H 11/10

[52] U.S. Cl. ..... 46/100; 46/202

[58] Field of Search ..... 46/97, 106, 107, 202, 46/201, 211, 92, 100, 101, 98, 99, 155, 1 R

[56] References Cited

U.S. PATENT DOCUMENTS

| | | | |
|---|---|---|---|
| 1,333,216 | 3/1920 | Pajeau | 46/201 |
| 1,533,772 | 4/1925 | Sloan | 46/202 X |
| 2,389,568 | 11/1945 | Townsley | 46/106 |
| 2,549,392 | 4/1951 | Sheridan | 46/92 X |
| 3,119,199 | 1/1964 | Byrnes | 46/107 X |

FOREIGN PATENT DOCUMENTS

| | | | |
|---|---|---|---|
| 820565 | 9/1951 | Fed. Rep. of Germany | 46/106 |

*Primary Examiner*—Mickey Yu

*Attorney, Agent, or Firm*—Watson, Cole, Grindle & Watson

[57] ABSTRACT

A rollable toy that tends to maintain rollable position regardless of its upset position, and having an interest-attracting device that moves to a visually appealing position regardless of the position of the toy.

9 Claims, 3 Drawing Figures

ROLLABLE TOY

The present invention relates in general to a toy adapted for use by children, and particularly for the amusement of pre-school children. More specifically, it relates to a child's toy which rolls by means of wheels. Such a rollable toy can be pulled by a string attached to one end of the toy or may be otherwise propelled, such as by battery or wind-up mechanism.

Rollable toys are, of course, well known in the art. When such toys are designed for young children, viz., those under the age of four, they will often have some types of interest-attracting device or feature in addition to the mere fact that they have wheels and can be pulled or propelled. Thus, interest-attracting features can be noise makers, movable objects, simulated human figures, or other devices whereby the rollable toy will be attractive to the child in addition to movement of the toy vehicle, itself. When such a young child uses a rollable toy, it is often true that because of the child's lack of expertise in use of the toy, the toy will be upset from its initial, rollable position, which is usually maintained by means of four or more wheels the axes of which are perpendicular to the longitudinal axis of the toy. Such upset of the toy vehicle can occur when movement is generated by the pull on a string and the string is pulled at such an angle that, because of the speed of pull and the center of gravity of the vehicle, it will be caused to tip over. Upsets can also be caused to occur when the vehicle strikes a stationary object of such weight that the vehicle will be caused to overturn rather than move the object.

The problem of providing a toy vehicle that will nevertheless be functional even in what might otherwise be considered an upset position has already been met by the art. Thus, in U.S. Pat. No. 1,333,216 to Pajeau, a wheeled toy is disclosed in which some wheels are mounted substantially perpendicularly to other wheels. When one set of wheels is acting as a supporting, rotatable surface for the toy vehicle, the other set of wheels, being mounted at substantially right angles to the supporting wheels, and not being in contact with the surface on which movement is taking place, will be nonfunctional. However, in the case of upset of the vehicle, the other set of wheels will often come into play, depending upon the force of the upset. In this manner, regardless of the position into which a wheeled toy, such as that disclosed in U.S. Pat. No. 1,333,216, is caused to rotate about its longitudinal axis, it will be in a position in which either of its sets of wheels will furnish a rotatable support. Thus, a child, particularly a small child, need not, for instance, drag a vehicle behind it and thereby incur significant impediment of its enjoyment of the toy, but can pull the wheeled vehicle with only the small coefficient of friction between the wheels and the ground or base surface to overcome.

The present invention relates to an improvement in such a wheeled toy vehicle, particularly one in which an interest-attracting device is embodied in such vehicle. It will be noted from an examination of U.S. Pat. No. 1,333,216 that no interest-attracting device is shown. This is because, as will be apparent, if any such interest-attracting device were mounted on the vehicle body in a fixed orientation relative to the ground or base surface, it might well protrude beyond the outer locus of points defined by the angular rotation of the wheels, which rotation accompanies a vehicle upset. The device, if it protruded to this extent, could cause the vehicle to drag along the base surface when operated in one of its upset positions and might even prevent a set of supporting wheels from functioning. Thus, an interest-attracting device might well destroy the functional value of the wheeled vehicle to perform regardless of its upset position.

Even if an interest-attracting device which is attached to the body in a fixed orientation relative to the ground or base surface did not protrude and did not thus prevent a supporting set of wheels from functioning, it would, nonetheless, have the defect that when the vehicle is in an upset position, the device would become reoriented relative to the ground or base surface. This reorientation which would be caused by the rotation of the vehicle body to the upset position can shift the device to either side of the rolling vehicle or even underneath the body of the rolling vehicle, causing the device to be unappealing or even not visible to the operator of the vehicle. This invention provides an interest-attracting device or devices which will be in visually appealing positions in all rollable orientations of the toy.

It is, therefore, a primary object to the present invention to provide a rollable toy that will roll in any upset position thereof in which the vehicle is rotated about its longitudinal axis, which rollable toy will further embody an interest-attracting device so mounted that it will not interfere with the ability of the toy to roll on a base surface in an upset position of the toy. It is another object of my invention to provide such a rollable toy in which the interest-attracting device is so mounted with respect to the remainder of the vehicle that it will move to a visually appealing position, generally an upright position, regardless of the set of wheels on which the toy is being supported. As used herein, the term "mounted on" is meant to refer to a joinder of two parts, whether or not the mounted part actually resides within the periphery of the other. Thus, the interest of a small child will be accentuated by the presence of the interest-attracting device embodied in the rollable toy, but such interest-attracting device will not in any way impair the basic advantage of the toy to rotate on its wheels in an upset position thereof. Moreover, the interest-attracting device will not assume an orientation that causes the device to be unappealing or even not visible to the operator of the vehicle.

To more specifically define my invention, I provide a rollable toy that is comprised of forward and rearward body members having rollable, toy-supporting wheels mounted thereon. The wheels are mounted so that some of them are radially displaced from other wheels with respect to the longitudinal axes of the body members, which are joined by a central section that contains the interest-attracting device. That device moves to a predetermined position regardless of the radial position of the body members and their wheels.

In more variants of my invention, the central section is in the form of a post that carries an interest-attracting device formed with an orifice through which the post extends in such a manner that the device is free to rotate about the post. Depending upon the center of gravity of the device, which may be controlled by weighting one end thereof, the device will move to an upright position regardless of the radial displacement of the body members about their longitudinal axis. In this manner, a rollable toy can be provided in which, for example, a replica of a human figure can be maintained in upright position between the forward and rearward body members that comprise the rollable toy.

In another variant embodiment of my invention, the central section that contains the interest-attracting device is a hollow and transparent tube. That central section can contain a liquid, sealed to prevent escape from the tube and viewable through the transparent side of the tube. A buoyant object, such as a boat, can be floated in the liquid in the central section, and thereby serve as the interest-attracting device. Thus, I provide a toy that both will maintain the interest of the child and yet will not have the disadvantage of being nonfunctional, either as a rollable toy or with respect to its interest-attracting device, in an upset position.

These and other objects, features and advantages of the present invention will become more apparent when taken in connection with preferred embodiments thereof as illustrated in the accompanying drawings, which form a part hereof and in which.

Figure 1:
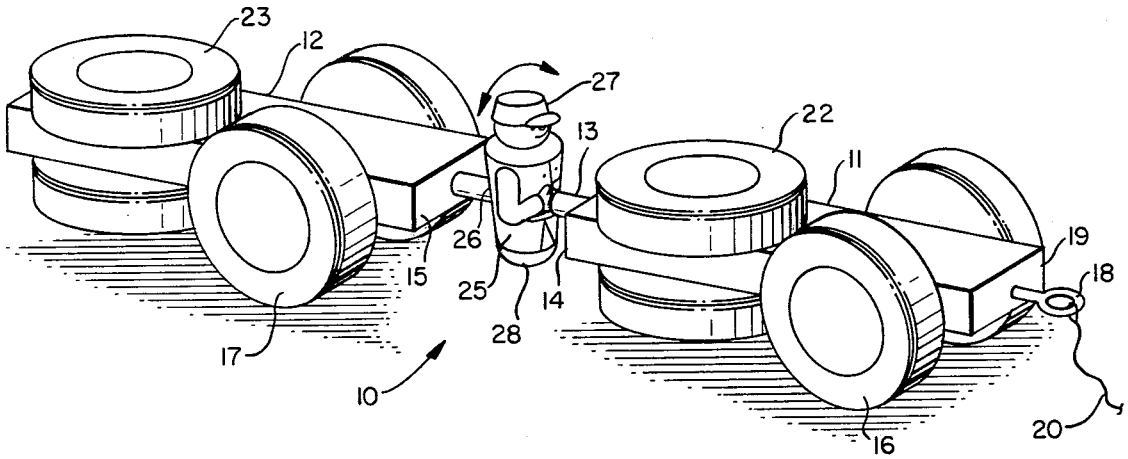
FIG. 1 is a perspective view of a preferred embodiment of the present invention.

Referring now to the drawings, and in particular to FIG. 1 thereof, what is shown therein is a rollable toy, generally indicated by reference numeral 10, formed from a forward body member 11 and a rearward body member 12. There body members are connected by a post 13 to which they are rigidly joined, the post serving as a dowel that fits tightly into holes in the opposed ends 14 and 15 of body members 11 and 12, respectively.

The rollable toy illustrated in the embodiment of FIG. 1 contains pairs of wheels on both the forward and rearward body members of the toy. Thus, pair of wheels 16 are mounted in rollable position on forward body member 11, and pair of wheels 17 are similarly mounted on rearward body member 12. In that position the wheels 16 and 17 support the rollable toy, which has an eye screw 18 embedded in end 19 of forward body member 11. A string 20 or other flexible members had one end tied to the eye of screw 18 and its other end, not shown, adapted to be grasped by the hand of a child.

Also mounted on the front body member 11 is another pair of wheels 22. The axis of wheels 22 is perpendicular to the axis of wheels 16. In a similar manner a pair of wheels 23 is mounted on rearward body member 12 in such a manner that the axis of the pair 23 is normal to the axis of the pair 17 of wheels on body member 12. It will thus be apparent that when the rollable toy 10 is moved to an upset position in which it is carried past the center of gravity of the toy so that the toy rotates about its longitudinal axis, such axis extending from the eye screw 18 through forward body member 11, dowel 13 and body member 12, a sufficient moment will enable the toy to move to a position in which the pairs 22 and 23 of wheels will become the supporting, rotatable members for the toy, thereby continuing the pleasure of the child in being able to continue to pull a wheeled toy or watch its continued movement.

As has been pointed out hereinabove, what has been designated as an interest-attracting device is an important part of the present invention. As shown in FIG. 1, the interest-attracting device is in the form of a rounded human figure 25, which has an orifice 26 extending through it. Post 13 extends through that orifice and, therefore, extends through the interest-attracting device 25. That device terminates upwardly in the head of a child, a train engineer, or other person. The head should remain in an upright position; therefore, a weight 28 is provided at the end of the device 25 opposite the head 27 to create a low center of gravity. When the rollable toy 10 is tipped, the device 25, being loosely mounted on dowel pin 13, will rotate so that weighted end 28 will be in a downward position, thereby forcing the child's head 27 into an upright position where it can be viewed with pleasure by the child utilizing the toy.

Figure 2:
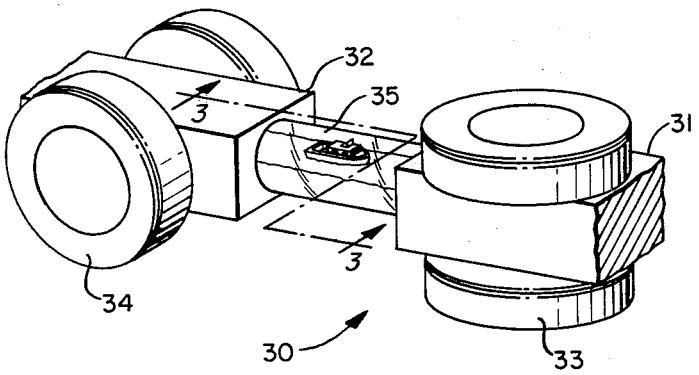
FIG. 2 is a fragmentary, perspective view of another embodiment of my invention.
Figure 3:
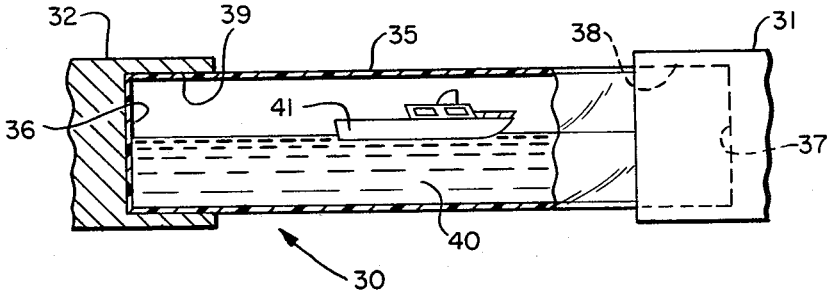
FIG. 3 is an enlarged view of the embodiment of FIG. 2 taken along with the line 3—3 thereof.

Another embodiment of the invention is illustrated in both FIG. 2 and FIG. 3. In FIG. 2, the body members and wheels correspond to those shown in the pull toy illustrated in FIG. 1. Thus, the toy 30 of FIG. 2 has a forward body member 31 and rearward body member 32, which together are adapted to roll on either pair of wheels 33 and another pair (not shown), or pair of wheels 34 on rearward body member and another pair on forward body member 31 (not shown). It is the central section 35 wherein the embodiment of FIGS. 2 and 3 differs from the embodiment of FIG. 1. As will best be seen in FIG. 3, that central section is a tube 35 that is hollow and transparent, and is sealed at both its ends 36 and 37. The tube 35 is mounted securely and nonrotatably within mating cavities 38 and 39 in opposed ends of body members 31 and 32, respectively. It will be best seen in FIG. 3 that, as so sealed, transparent tube 35 can maintain a body of water 40 that occupies perhaps one-half of the internal volume of tube 35. A boat 41 can be floated on the water 40, and it will be apparent that no matter how the toy 30 is rotated about is longitudinal axis, the water 40 will seek its gravitational level and the boat 41 will do likewise, thereby always floating on the water.

Two embodiments of my invention have been illustrated, and at this time these are deemed to be the best modes presently contemplated carrying out my invention and particularly of carrying out the interest-attracting device that moves regardless of the radial position of the body members with respect to the longitudinal axis of the toy. Other embodiments could include, simply by way of example, weighted wings that would actuate a clicker mechanism attached to one of the vehicle body members, a multicolored, thin disc that would spin during roll over of the toy, or a thick disc the periphery of which is painted with different colors and which would likewise spin during toy roll over. In any case, the interest-attracting device would move to new positions with the rollover of the toy, thereby creating an effect, whether visual or sonic, that would be amusing to a small child and would absorb the interest of that child.

The above and other modifications of my rollable toy will appear obvious to those of skill in this art and, therefore, I desire that all obvious modifications be included within the scope of my invention, which is to be limited only by the purview, including equivalents, of the following appended claims.

I claim:

1. A rollable toy that tends to maintain a rollable position regardless of rotation about an axis thereof, comprising a toy body formed by forward and rearward body members spaced from each other by a central body section to which said body members are mounted against relative rotation, rollable supporting wheels mounted on each of said forward and rearward body members in positions radially displaced from each other with respect to the longitudinal axis of said body, and an interest-attracting device mounted on said central body section by means to enable it to move to a visually interesting position regardless of the radial position of said toy body by motion about said central body section during rotation of said toy body.

2. A rollable toy as claimed in claim 1, in which certain of said wheels are displaced radially by 90 degrees from others of said wheels.

3. A rollable toy as claimed in claim 1, in which said central body section is a post extending through an orifice in said interest-attracting device, said device being free to rotate with respect to said post.

4. A rollable toy as claimed in claim 3, in which the center of gravity of said device is such that, upon rotation thereof on said post, said device will move to an upright position.

5. A rollable toy as claimed in claim 4, in which said device is weighted at on end thereof, the other end of said device being shaped in a human form.

6. A rollable toy as claimed in claim 1, in which said central body section is hollow and transparent.

7. A rollable toy as claimed in claim 6, in which said central body section contains a liquid.

8. A rollable toy as claimed in claim 7, in which said central body section further contains a buoyant object that floats in said liquid.

9. A rollable toy as claimed in claim 8, in which said buoyant object is a simulated boat.

* * * * *